US005576273A

United States Patent [19]

Karol et al.

[11] Patent Number: 5,576,273

[45] Date of Patent: Nov. 19, 1996

[54] LUBRICATING COMPOSITIONS CONTAINING BISMUTH COMPOUNDS

[75] Inventors: Thomas J. Karol, Norwalk; Steven G. Donnelly, New Fairfield; Ronald J. Hiza, Monroe, all of Conn.

[73] Assignee: R.T. Vanderbilt Company, Inc., Norwalk, Conn.

[21] Appl. No.: 560,669

[22] Filed: Nov. 20, 1995

[51] Int. Cl.[6] ..... C10M 129/16; C10M 135/18; C10M 141/12; C10M 157/10

[52] U.S. Cl. ..... 508/364; 508/380; 508/385; 508/459

[58] Field of Search ..... 252/35, 32.7 E, 252/33.6; 508/364, 380, 385, 459

[56] References Cited

U.S. PATENT DOCUMENTS

| | | | |
|---|---|---|---|
| 2,492,314 | 12/1949 | Olin et al. . | |
| 2,716,089 | 8/1955 | Cyphers | 252/33.6 |
| 3,028,334 | 4/1962 | Wilson | 252/35 |
| 3,139,405 | 6/1964 | Farmer et al. | 252/33.6 |
| 3,234,129 | 2/1966 | Perilstein | 252/32.7 |
| 3,523,081 | 8/1970 | Braid | 252/32.7 |
| 3,595,792 | 7/1971 | Elliott et al. | 252/32.7 |
| 3,630,897 | 12/1971 | Rohde et al. | 252/33.6 |
| 3,772,197 | 11/1973 | Milsom | 252/33.2 |
| 4,524,185 | 6/1985 | Hinderer | 525/328.2 |
| 4,648,985 | 3/1987 | Thorsell et al. | 252/32.35 |
| 5,385,683 | 1/1995 | Ransom | 252/35 |

FOREIGN PATENT DOCUMENTS

| | | | |
|---|---|---|---|
| 9424100 | 10/1994 | WIPO | C07C 333/16 |

*Primary Examiner*—Margaret Medley
*Attorney, Agent, or Firm*—Rasma B. Balodis

[57] ABSTRACT

This invention relates to synergistic extreme pressure compositions comprising (1) an alkylenebis(dihydrocarbyldithiocarbamate) compound and (2) a bismuth compound selected from the group consisting of bismuth carboxylates, bismuth dihydrocarbyldithiocarbamates and bismuth dihydrocarbylphosphorodithioates.

Lubricating compositions containing the synergistic compositions possess good extreme pressure properties.

10 Claims, No Drawings

LUBRICATING COMPOSITIONS CONTAINING BISMUTH COMPOUNDS

BACKGROUND OF THE INVENTION

The invention concerns lubricating compositions having improved properties. Another aspect of the invention relates to additive compositions which impart extreme pressure properties to lubricating compositions.

Additives known as extreme pressure agents are employed to increase the load carrying capacity of lubricants. The extreme pressure agents promote the formation of a surface film and thereby prevent wear, welding and abrasion of the contacting surfaces. When used in lubrication of internal combustion engines, the mechanical efficiency enhanced by decreased friction loss further results in decreased fuel consumption and energy savings.

It is known that certain bismuth based compositions possess antifriction properties. U.S. Pat. No. 5,385,683 discloses antifriction compositions composed of bismuth 2-(ethylhexanoate or neodecanoate and a tin compound. Bismuth dithiocarbamate compounds are disclosed as antioxidants in U.S. Pat. No. 2,716,089 and as extreme pressure agents in U.S. Pat. No. 3,139,405. Polyvalent metal carboxylate-coordinated slats of phosphorodithioates as antioxidants are taught by U.S. Pat. No. 3,523,081.

Extreme pressure compositions based on alkylenebisdithiocarbamates are known lubricating additives. U.S. Pat. No. 4,648,985 discloses extreme pressure additive system composed of an alkylenebisdithiocarbamate, copper dithiocarbamate and metal phosphorodithioate.

Surprisingly, it has been now discovered that certain bismuth compounds described therein produce synergistic extreme pressure effect in combination with alkylenebisdithiocarbamates.

SUMMARY OF THE INVENTION

According to the invention, there are provided synergistic extreme pressure compositions comprising (1) bisdithiocarbamate compound of the formula

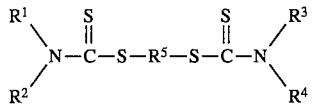

(I)

wherein $R^1$, $R^2$, $R^3$, and $R^4$ are aliphatic hydrocarbyl groups having 2 to 13 carbon atoms and $R^5$ is an alkylene group having 1 to 8 carbon atoms; and (2) a bismuth compound selected from the group consisting of (i) bismuth carboxylates of the formula

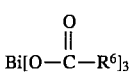

(II)

wherein $R^6$ represents alkyl and alkenyl group, fatty alkyl radical and naphthenic radical, (ii) bismuth dithiocarbamates of the formula

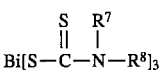

(III)

wherein $R^7$ and $R^8$ are hydrocarbyl groups selected independently from alkyl, alkenyl, cycloalkyl, aryl, alkaryl and arylalkyl groups, and (iii) bismuth phosphorodithioates of the formula

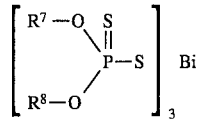

(IV)

wherein $R^7$ and $R^8$ represent groups defined in (ii), and mixtures thereof and the ratio of the bisdithiocarbamate compound of the bismuth compound based on the weight of the bismuth ranges from about 1 to 0.0035 to about 1 to 0.089.

Another aspect of the invention concerns lubricating compositions having improved lubricating properties and comprising a major portion of an oil of lubricating viscosity and about 0.5 to 10.0 percent by weight of a composition comprising (1) a bisdithiocarbamate compound of formula (I) and (2) a bismuth compound of formula (II), (III) or (IV) or mixtures thereof.

DETAILED DESCRIPTION OF THE INVENTION

The bisdithiocarbamates of formula I are known compounds described in U.S. Pat. No. 4,648,985 incorporated herein by reference. The compounds are characterized by substituent groups $R^1$ to $R^4$ which are the same or different and are hydrocarbyl groups having 2 to 13 carbon atoms. Preferred are branched or straight chain alkyl groups having 4 to 8 carbon atoms. The group $R^5$ connecting the two dithiocarbamate groups is an aliphatic group, preferably a straight or branched alkylene group containing 1 to 8 carbon atoms. Particularly preferred is methylenebis(dibutyldithiocarbamate) available commercially under the trade name VANLUBE® 7723 from R. T. Vanderbilt Company, Inc.

Bismuth carboxylates of formula II are available commercially. Preferred are bismuth salts of fatty acids as for example bismuth octoate, bismuth 2-ethylhexoate, and bismuth hexoate. Particularly preferred are bismuth salts of naphthenic acid.

Naphthenic acids are derived from petroleum during the refining of the various distillation fractions. These acids are predominately monocarboxylic, monocyclic and saturated. The predominant acids that are present in naphthenic acids can be described by the structural formula:

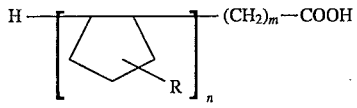

where n may range from 1 to 5 and a small fraction of the rings may be cyclohexyl. The substituent R group is a lower chain alkyl group and m is greater than 1. Commercial naphthenic acids are mixtures of these acids having molecular weight in the range of 180 to 350.

Bismuth dithiocarbamates of formula III are known compounds described in U.S. Pat. No. 3,139,405. The dithiocarbamates can be prepared by directly reacting primary or secondary amine, carbon disulfide and oxide or hydroxide of bismuth as described in U.S. Pat. No. 2,492,314.

Alternately, bismuth dithiocarbamates may be prepared from a secondary amine and carbon disulfide in the presence of bismuth carboxylate and a metal oxide or hydroxide. Preferred are oxide and hydroxides selected from alkali metals, alkaline earth metals and zinc. In this reaction, the intermediate metal dithiocarbamate is formed in situ and an exchange takes place between the intermediate and the bismuth carboxylate. If metal oxide is not added to the reaction, the ion exchange will take place between the dithiocarbamic alkyl ammonium salt intermediate and bismuth carboxylate. The final reaction mixture then will contain bismuth dithiocarbamate and carboxylic acid. These reaction mixtures are particularly preferred for ease of incorporation into lubricating formulations. The reaction mixtures can be further diluted with a diluent compatible with the lubricating formulations. A preferred diluent is 2-hydroxyethyl-N-octadecylimidazole, especially for reaction mixtures that are viscous.

Bismuth phosphorodithioates can be prepared by known methods described in U.S. Pat. No. 3,523,081. Alternately, bismuth phosphorodithioates can be prepared by reacting a dihydrocarbylphosphorodithioate with bismuth carboxylate by an exchange reaction. The final reaction mixture then will contain bismuth phosphoro-dithioate and carboxylic acid.

Unexpectedly, the above described alkylenebisdithiocarbamates produce synergistic extreme pressure effect when combined with bismuth compounds in certain ratios.

Synergism is displayed by compositions wherein the ratio of the bisdithiocarbamate to the bismuth compound based on the weight of the bismuth ranges from about 1 to 0.0035 to about 1 to 0.089. Since bismuth is relatively expensive, it is more economical to use compositions having lower ratios of the bisdithiocarbamate to the bismuth compound based on the weight of the bismuth ranging from about 1 to 0.0035 to about 1 to 0.018.

When bismuth dithiocarbamates and phosphorodithioates are prepared by the above described exchange reaction and contain the carboxylic acid byproduct, the entire reaction product can be incorporated in the lubricating formulation together with the bisdithiocarbamate compound. In that case, the synergistic ratios can be based on the weight of the reaction mixture and are ranging from up to one part by weight of bisdithiocarbamate to 0.067 to 1.667 parts by weight bismuth compound. Preferred are compositions containing 1 part by weight bisdithiocarbamate compound to 0.067 to 0.333 parts by weight bismuth compound.

The synergistic compositions may be incorporated in any lubricating media by known methods. The compositions impart extreme pressure properties to natural and synthetic lubricants formulated as oils or greases.

The base oils employed as lubricant vehicles are typical natural and synthetic oils used in automotive and industrial applications such as, among others, turbine oils, hydraulic oils, gear oils, crankcase oils and diesel oils. Natural base oils include mineral oils, petroleum oils, paraffinic oils and the ecologically desirable vegetable oils. Typical synthetic oils include ester-type oils such as pentaerythritol esters, hydrogenated mineral oils, silicones and silanes.

The compositions of the invention may be incorporated in the lubricant in an amount effective to produce the desired extreme pressure characteristics. An amount from about 0.5 to 10.0 percent will be sufficient for most applications. A preferred range is from about 2.0 to about 4.0 percent by weight of the total lubricant composition.

The lubricating compositions may contain other conventional additives depending on the intended use of the lubricant. For example, formulations may contain rust inhibitors such as metal salts of alkylnaphthalenesulfonic acids, demulsifiers, dispersants, detergents and the like.

The grease formulations may contain various thickening agents such as, among others, silicate minerals, metal soaps and organic polymers.

The following examples are given for the purpose of illustrating the invention and are not intended in any way to limit the invention. All percentages and parts are based on weight unless otherwise indicated.

EXAMPLE 1

Extreme Pressure Test

The load carrying properties of lithium 12-OH stearate grease containing the compositions of the invention were tested by the Timken method conducted essentially according to the ASTM D2509-93 procedure. The tester was operated with a steel cup rotating against a steel test block at 800 rpm. The load carrying capacity was measured in kg after 10 min. The test samples contained additives referenced in Table I.

Sample A was a control, Li 12-OH base grease containing no additives manufactured by Witco Company. Sample B contained methylenebis(dibutyldithiocarbamate), identified in he table as bisdithiocarbamate. Sample C contained bismuth dipentyldithiocarbamate in admixture with zinc naphthenate prepared by the method described in Example 2. Example D contained bismuth naphthenate containing 14.96% bismuth (LIOVAC® 3016 manufactured by MIRACEMA NUODEX Industria Quimica LTDA). Sample E contained bismuth di(2-ethylhexyl)-phosphorodithioate in admixture with octanoic acid prepared by the method described in Example 3. The steel test blocks were inspected visually for wear. A severe form of wear is characterized by the formation of extensive grooves and scratches in the direction of sliding, so called scoring. The samples that thusly failed to carry the Timken load of 18.14 kg as well as 22.68 kg are rated "F" in the table. They showed no extreme pressure activity at these loads. The samples that contained the combination of the invention could carry the Timken load. That is, they showed good extreme pressure activity and are rated "P" in the table.

EXAMPLE 2

A reaction vessel was charged with bismuth naphthenate, 205.51 g, 0.18 moles B1 (18% Bismuth, Nap-Al)™ manufactured by the OM Group, Inc.) and zinc dipentyldithiocarbamate, 142.83 g, 0.27 moles in 50% petroleum oil diluent. The reaction mixtures was reacted at room temperature to yield bismuth dipentyldithiocarbamate and zinc naphthenate. The reaction mixture contained 5.3 percent bismuth (theoretical).

TABLE I

| | Extreme Pressure Test | | | | | | | | | | | | | |
|---|---|---|---|---|---|---|---|---|---|---|---|---|---|---|
| | Active Concentration, Mass Percent | | | | | | | | | | | | | |
| Active Ingredient | A | B | C | D | E | F | G | H | I | J | K | L | M | N |
| Bisdithiocarbonate | — | 3.0 | — | — | — | 2.8125 | 2.625 | 2.25 | 1.5 | 1.125 | 2.8 | 2.6 | 2.75 | 2.5 |
| Bismuth dithiocarbamate (Example 2) | — | — | 3.0 | — | — | 0.1875 | 0.375 | 0.75 | 1.5 | 1.875 | — | — | — | — |
| Bismuth naphthenate | — | — | — | 3.0 | — | — | — | — | — | — | 0.2 | 0.4 | — | — |
| Bismuth phosphorodithioate (Example 3) | — | — | — | — | 3.0 | — | — | — | — | — | — | — | 0.25 | 0.5 |
| Timken Load, 22.68 kg | F | F | F | F | F | P | P | P | P | P | P | P | P | P |
| Timken Load, 18.14 kg | F | F | F | F | F | | | | | | | | | |

EXAMPLE 3

A three neck reaction flask with a stirrer was charged with 91.0% di-2(ethylhexyl)phosphorodithioic acid, 80.0 g., 0.207 moles. To this was rapidly added bismuth octanoate, 60.0 g., 0.069 moles (24% bismuth, Liovac 3024). The reaction oxothermed to 70° C. and turned dark green. Additional bismuth octanoate was added in 0.25 g portions until the color changed to clear bright yellow. After cooling to room temperature, the product was filtered. The product containing 10.5% bismuth and was a mixture of bismuth di-2(ethylhexyl)phosphorodithioate and octanoic acid.

EXAMPLE 4

Extreme Pressure Test

The load carrying properties of lithium 12-OH stearate grease containing compositions of the invention were tested by the Timken method as described in Example 1. Sample O was a control, Li 12-OH Grease containing no additives manufactured by Shell Company. Sample P contained methylenebis(dibutyldithiocarbamate), identified in the table as bisdithiocarbamate. Sample R contained bismuth neodecanoate containing 16% bismuth. Sample S contained the composition of the invention showing good synergistic extreme pressure property. The data are compiled in Table II.

TABLE II

| | Extreme Pressure Test | | | |
|---|---|---|---|---|
| | Active Concentration, Mass Percent | | | |
| Active Ingredient | O | P | R | S |
| Li 12-OH Grease | 100 | 96.5 | 96.5 | 96.5 |
| Bisdithiocarbamate | — | 3.5 | — | 3.0 |
| Bismuth neodecanoate | — | — | 3.5 | 0.5 |
| Timken Load, 18.14 kg | F | F | F | — |
| Timken Load, 22.68 kg | F | F | F | P |

The above embodiments have shown various aspects of the present invention. Other variations will be evident to those skilled in the art and such modifications are intended to be within the scope of the invention as defined by the appended claims.

We claim:

1. A synergistic extreme pressure composition consisting of (a) a bisdithiocarbamate compound of the formula

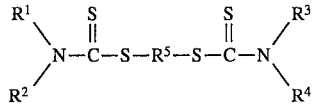

wherein $R^1$, $R^2$, $R^3$ and $R^4$ are aliphatic hydrocarbyl groups having 2 to 13 carbon atoms and $R^5$ is an alkylene group having 1 to 8 carbon atoms; and (b) a bismuth compound selected from the group consisting of (i) bismuth carboxylates of the formula

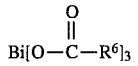

wherein $R^6$ represents alkyl and alkenyl group, fatty alkyl radical and naphthenic radical, (ii) bismuth dithiocarbamates of the formula

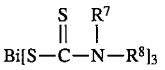

wherein $R^7$ and $R^8$ are hydrocarbyl groups selected independently from alkyl, alkenyl, cycloalkyl, aryl, alkaryl and arylalkyl groups, and (iii) bismuth phosphorodithioates of the formula

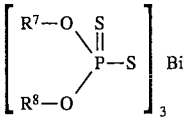

wherein $R^7$ and $R^8$ represent hydrocarbyl groups selected independently from alkyl, alkenyl, cycloalkyl, aryl, alkaryl and arylalkyl groups and the ratio of the bisdithiocarbamate compound to the bismuth compound based on the weight of bismuth is about 1 to 0.0035 to about 1 to 0.089.

2. A composition according to claim 1 wherein the bisdithiocarbamate compound is methylenebis(dibutyldithiocarbamate).

3. A composition according to claim 1 wherein the bismuth compound is bismuth dipentyldithiocarbamate.

4. A composition according to claim 1 wherein the bismuth compound is bismuth alkyl carboxylate.

5. A composition according to claim 1 wherein the bismuth compound is bismuth di((2-ethylhexyl)phosphorodithioate.

6. A lubricating composition comprising an oil of lubricating viscosity and about 0.5 to 10.0 percent by weight of a synergistic extreme pressure composition consisting of (a) a bisdithiocarbamate compound of the formula

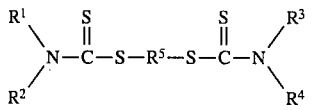

wherein $R^1$, $R^2$, $R^3$, and $R^4$ are aliphatic hydrocaryl groups having 2 to 13 carbon atoms and $R^5$ is an alkylene group having 1 to 8 carbon atoms; and (b) a bismuth compound selected from the group consisting of (i) bismuth carboxylates of the formula

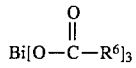

wherein $R^6$ represents alkyl and alkenyl group, fatty alkyl radical and naphthenic radical, (ii) bismuth dithiocarbamates of the formula

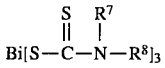

wherein $R^7$ and $R^8$ are hydrocarbyl groups selected independently from alkyl, alkenyl, cycloalkyl, aryl, alkaryl and arylalkyl groups, and (iii) bismuth phosphorodithioates of the formula

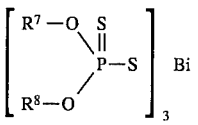

wherein $R^7$ and $R^8$ represents hydrocarbyl groups selected independently from alkyl, alkenyl, cycloalkyl, aryl, alkaryl and arylalkyl groups and the ratio of the bisdithiocarbamate compound to the bismuth compound based on the weight of bismuth is about 1 to 0.0035 to about 1 to 0.089.

7. A composition according to claim 6 which further contains a thickener.

8. A lubricating composition comprising an oil of lubricating viscosity and about 0.5 to 10.0 percent by weight of a synergistic extreme pressure composition consisting of (a) a bisdithiocarbamate compound of the formula

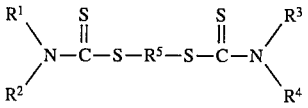

wherein $R^1$, $R^2$, $R^3$, and $R^4$ are aliphatic hydrocaryl groups having 2 to 13 carbon atoms and $R^5$ is an alkylene group having 1 to 8 carbon atoms; and (b) a bismuth phosphorodithioate in admixture with carboxylic acid prepared by reacting equivalent ratios of (i) bismuth carboxylates of the formula

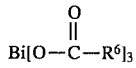

wherein $R^6$ represents alkyl and alkenyl group, fatty alkyl radical and naphthenic radical, and (ii) bismuth dithiocarbamates of the formula

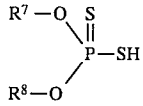

wherein $R^7$ and $R^8$ are hydrocarbyl groups selected independently from alkyl, alkenyl, cycloalkyl, aryl, alkaryl and arylalkyl groups; and wherein the synergistic composition contains a ratio of bisdithiocarbamate to the bismuth compound based on the weight of the bismuth ranging from about 1 to 0.0035 to about 1 to 0.089.

9. A composition according to claim 8 wherein the synergistic extreme pressure composition consists of (a) methylenebis(dibutyldithiocarbamate) and (b) bismuth phosphorodithioate in admixture with carboxylic acid prepared by reacting (i) bismuth 2-ethylhexoate and (ii) di(2-ethylhexyl)phosphorodithioic acid.

10. A lubricating composition comprising an oil of lubricating viscosity and about 0.5 to 10.0 percent by weight of a synergistic extreme pressure composition consisting of (a) a bisdithiocarbamate compound of the formula

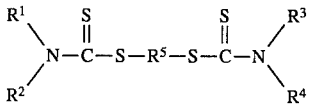

wherein $R^1$, $R^2$, $R^3$, and $R^4$ are aliphatic hydrocaryl groups having 2 to 13 carbon atoms and $R^5$ is an alkylene group having 1 to 8 carbon atoms; and (b) a bismuth dithiocarbamate in admixture with a carboxylate prepared by reacting equimolar ratios of (i) bismuth carboxylates of the formula

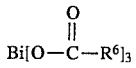

wherein $R^6$ represents alkyl and alkenyl group, fatty alkyl radical and naphthenic radical, and (ii)

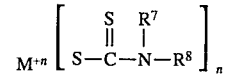

(ii)

wherein $R^7$ and $R^8$ are hydrocarbyl groups selected independently from alkyl, alkenyl, cycloalkyl, aryl, alkaryl and arylalkyl groups, n is 1 or 2 and M is a metal selected from alkali metals and alkaline earth metals, and wherein the synergistic composition contains a ratio of bisdithiocarbamate to the bismuth compound based on the weight of the bismuth ranging from about 1 to 0.0035 to about 1 to 0.089.

* * * * *

UNITED STATES PATENT AND TRADEMARK OFFICE

CERTIFICATE OF CORRECTION

PATENT NO. : 5,576,273

DATED : November 19, 1996

INVENTOR(S) : Thomas J. Karol , Steven G. Donnelly and Ronald J. Hiza

It is certified that error appears in the above-identified patent and that said Letters Patent is hereby corrected as shown below:

At column 1, line 22
"2-(ethylhexanoate" should read --2-ethylhexanoate--;

At column 1, line 26
"slats" should read --salts--;

At column 4, line 30
"in he" should read --in the--;

At column 4, line 52
"Bl (18% Bismuth, Nap-Al)™" should read --Bi(18% Bismuth, Nap-All™ --;

At column 4, line 55
"reaction mixtures" should read --reaction mixture--;

At column 5, Table I, line 5
"Bisdithiocartonate" should read --Bisdithiocarbamate--;

At column 5, line 23
"oxothermed" should read --exothermed--;

UNITED STATES PATENT AND TRADEMARK OFFICE

CERTIFICATE OF CORRECTION

PATENT NO. : 5,576,273

DATED : November 19, 1996

INVENTOR(S) : Thomas J. Karol, Steven G. Donnelly and Ronald J. Hiza

It is certified that error appears in the above-identified patent and that said Letters Patent is hereby corrected as shown below:

At column 7, line 8
"hydrocaryl" should read --hydrocarbyl--;

At column 7, line 36
"represents" should read --represent--;

At column 7, line 53
"hydrocaryl" should read --hydrocarbyl--;

At column 8, line 35
"hydrocaryl" should read --hydrocarbyl--.

Signed and Sealed this

Eleventh Day of March, 1997

*Attest:*

*Attesting Officer*

BRUCE LEHMAN

*Commissioner of Patents and Trademarks*